US005868317A

United States Patent [19]

English

[11] Patent Number: 5,868,317

[45] Date of Patent: Feb. 9, 1999

[54] STEPPED RATE SHAPING FUEL INJECTOR

[75] Inventor: Paul R. English, Chillicothe, Ill.

[73] Assignee: Caterpillar Inc., Peoria, Ill.

[21] Appl. No.: 920,259

[22] Filed: Aug. 22, 1997

[51] Int. Cl.[6] ..... F02M 47/02

[52] U.S. Cl. ..... 239/88; 239/91; 239/92; 239/533.4; 239/533.8

[58] Field of Search ..... 239/88, 90, 91, 239/92, 94, 96, 533.4, 533.5, 533.8, 533.9, 585.1, 585.2

[56] References Cited

U.S. PATENT DOCUMENTS

| | | | |
|---|---|---|---|
| 1,123,678 | 1/1915 | Burlingham . | |
| 3,533,596 | 10/1970 | Daume et al. | 251/61 |
| 3,974,910 | 8/1976 | Papai | 198/203 |
| 4,561,344 | 12/1985 | Klocke et al. | 91/358 |
| 5,062,268 | 11/1991 | Dunwoody | 60/533 |
| 5,197,285 | 3/1993 | Dunwoody | 60/562 |
| 5,423,484 | 6/1995 | Zuo | 239/90 |
| 5,477,932 | 12/1995 | Asakura et al. | 173/16 |
| 5,522,545 | 6/1996 | Camplin et al. | 239/92 |
| 5,566,660 | 10/1996 | Camplin et al. | 123/496 |
| 5,597,118 | 1/1997 | Carter, Jr. et al. | 239/92 |
| 5,641,121 | 6/1997 | Beck et al. | 239/92 |
| 5,713,520 | 2/1998 | Glassy et al. | 239/92 |

FOREIGN PATENT DOCUMENTS

| | | | |
|---|---|---|---|
| 2 295 649 | 5/1996 | United Kingdom | F02M 59/46 |

*Primary Examiner*—Kenneth Bomberg
*Assistant Examiner*—Robin O. Evans
*Attorney, Agent, or Firm*—Alan J. Hickman

[57] ABSTRACT

A fuel injector having a plurality of spaced apart apertures modifies the rate of fluid flow of the fuel injectors. The apertures are sequentially opened by movement of the intensifier piston in a piston bore passing actuating fluid flow at an increasing rate to a piston pressure chamber defined by a first end surface of the intensifier piston, a closed end surface of the piston bore and the cylindrical surface of the piston bore. The opening of the spaced apart fluid delivery apertures provide a stepped rate trace. The stepped rate trace allows less fuel to be injected into the combustion chamber by injecting the fuel slower during the early phase of the combustion process where combustion is less harsh.

11 Claims, 4 Drawing Sheets

STEPPED RATE SHAPING FUEL INJECTOR

TECHNICAL FIELD

This invention relates generally to a fuel injector, and more particularly to a fuel injector having a plurality of spaced apart apertures for modifying the rate of fluid flow delivered by the fuel injector.

BACKGROUND ART

Engine exhaust emission regulations are becoming increasingly restrictive. Over the years engineers have discovered that engine exhaust emissions can be significantly reduced at certain operating conditions by providing a particular injection flow rate identified by a rate trace. In many cases engine exhaust emissions are improved when the initial injection flow rate of the fuel injector is controlled. Prior rate trace techniques are concerned with modifying the slope associated with the linear portion of the rate trace by providing a slower injection pressure rise versus time. The slower rise improves emissions at start up and low idle conditions by injecting less fuel into the combustion chamber compared to full load conditions. While these techniques have some ability to reduce emissions, there remains room to improve the rate trace at the start of injection.

Another problem, fuel consumption is becoming more of an operational expense. Over the years, engineers have discovered that engine fuel consumption is significantly improved at certain operating conditions by providing a particular injection flow rate identified by a rate trace. In many cases fuel consumption can be improved during the early phase of the combustion process. In many cases engine fuel consumption is improved when the initial injection flow rate of the fuel injector is controlled. Prior rate trace techniques are concerned with modifying the slope associated with the linear portion of the rate trace by providing a slower injection pressure rise versus time. The slower rise improves fuel consumption at start up and low idle conditions by injecting less fuel into the combustion chamber compared to full load conditions. While these techniques have some ability to reduce fuel consumption, there remains room to improve the rate trace at the start of injection.

Yet another problem, engine noise is becoming increasingly restrictive. Over the years, engineers have discovered that engine noise can be significantly reduced by injecting the fuel slower during the early phase of the combustion process where combustion is less harsh. In many cases engine noise is improved when the initial injection flow rate of the fuel injector is controlled. Prior rate trace techniques are concerned with modifying the slope associated with the linear portion of the rate trace by providing a slower injection pressure rise versus time. The slower rise improves engine noise at start up and low idle conditions by injecting less fuel into the combustion chamber compared to full load conditions. While these techniques have some ability to reduce engine noise, there remains room to improve the rate trace at the start of injection.

The present invention is directed to overcoming one or more of the problems as set forth above.

DISCLOSURE OF THE INVENTION

In one aspect of the present invention, a stepped rate shaping fuel injector includes a casing having a body receiving bore. A body which has a piston bore defined by a cylindrical surface, and a longitudinal axis. The piston bore has a closed end surface. The body is disposed in the body receiving bore. An intensifier piston has a first end surface and is slidably axially movably disposed in the piston bore. A piston pressure chamber which is defined by the first end surface of the intensifier piston, the closed end surface of the piston bore and the cylindrical surface. A plurality of spaced apart fluid delivery apertures are disposed in the body and open into the piston bore. The intensifier piston is axially movable in a first direction in response to a pressurized fluid being passed through a first of said apertures into said piston pressure chamber, and a second of the apertures being open to pressurized fluid flow into said piston pressure chamber in response to further movement of the intensifier piston in the first direction. The intensifier piston moves at a first rate of speed passing pressurized fluid through said first of said aperture, and a second rate of speed passing pressurized fluid through said second of said apertures, said second rate of speed being greater than said first rate of speed.

In another aspect of the present invention, a stepped rate shaping fuel injector includes a casing which has a body receiving bore. A body which has a piston bore defined by a cylindrical surface, and a longitudinal axis. The piston bore has a closed end surface. The body is disposed in the body receiving bore. A piston has a first end surface and a second surface. The first end surface is slidably axially movably disposed in the piston bore, and the second surface is opposite from the first end surface. A piston pressure chamber defined by the first end surface of the piston, the closed end surface of the piston bore and the cylindrical surface. A barrel has a plunger receiving bore. The plunger receiving bore is defined by a cylindrical surface. The barrel is disposed in the body receiving bore. A plunger which has first and second spaced apart ends. The first end is engaged with the second surface of the piston and the second end is disposed in the barrel. The plunger is slidably axially movably disposed in the plunger receiving bore. A nozzle assembly has an end surface and is engaged with the barrel. The nozzle assembly is disposed in the body receiving bore. A plunger pressure chamber defined by the second end surface of the plunger, the end surface of the nozzle assembly and the cylindrical surface of the barrel. A plurality of spaced apart fluid delivery apertures disposed in the body and opening into the piston bore. The piston is axially movable in a first direction in response to a pressurized fluid being passed through a first of the apertures into the piston pressure chamber, and a second of the apertures being open to pressurized fluid flow into the chamber in response to further movement of the piston in the first direction. The plunger is moving at a first rate of speed passing pressurized fluid through said first of the apertures, and a second rate of speed passing the pressurized fluid through said second of said apertures. The second rate of speed being greater than said first rate of speed.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
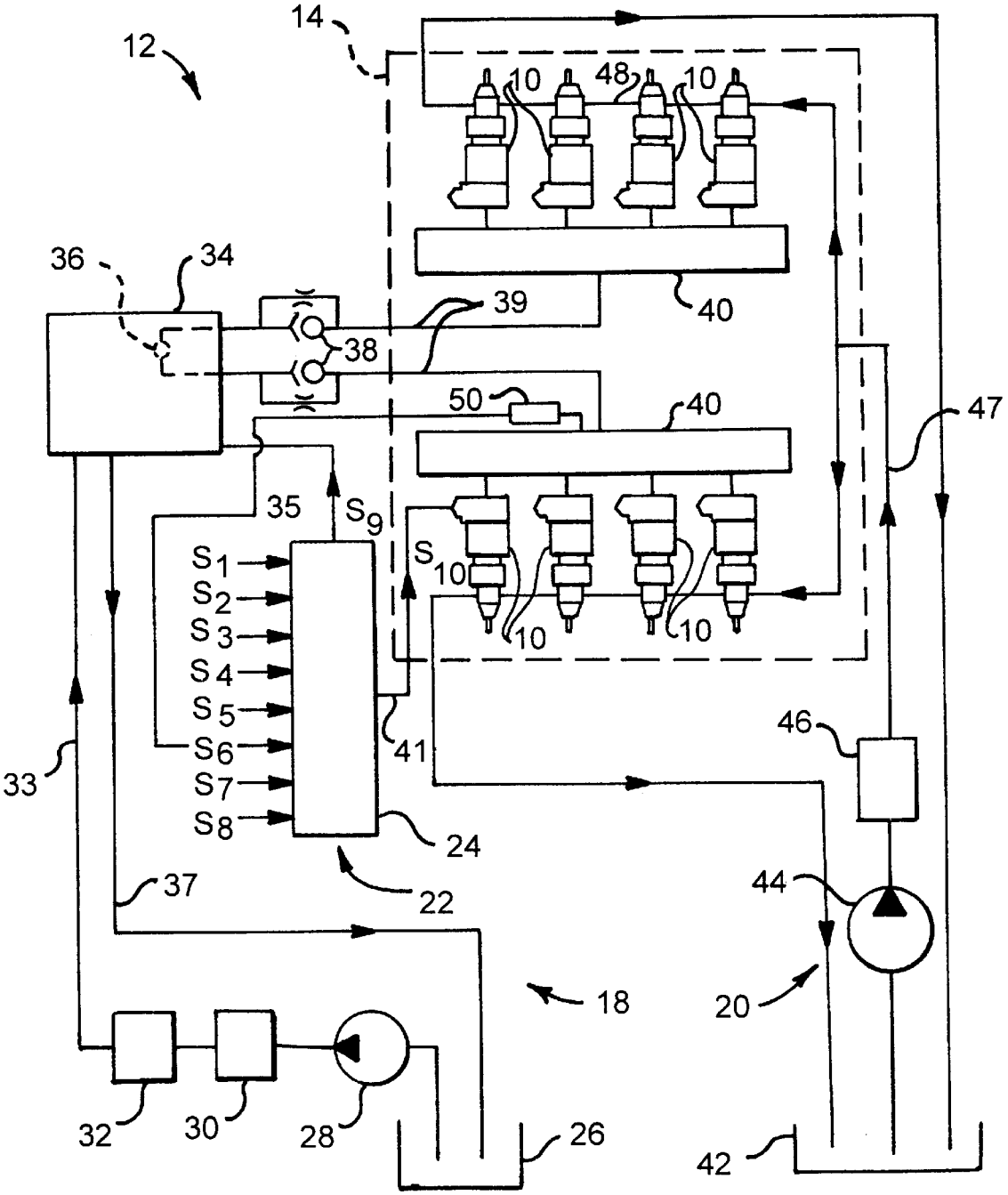
FIG. 1 is a diagrammatic schematic representation of an embodiment of the present invention showing a hydraulically-actuated electronically-controlled unit injector fuel system having both an actuating fluid circuit and a fuel injection circuit for an eight cylinder internal combustion engine.

Referring to FIG. 1, a hydraulically-actuated electronically-controlled fuel system 12, hereinafter referred to as a HEUI fuel system 12 is shown with a hydraulically-actuated electronically-controlled unit injector 10, hereinafter referred to as a HEUI injector which utilizes a stepped injection flow rate shape which is identified by its corresponding rate trace. It is to be recognized that, injection flow rate shaping is also used with other types of fuel injectors, including, but not limited to, mechanically-actuated electronically-controlled unit injectors, and injection pumps used in pump-line-nozzle fuel injection systems.

The HEUI injectors 10 shown in FIG. 1 are employed with a diesel-cycle direct-injection internal combustion engine 14. While a V-eight type engine is illustrated in FIG. 1 and described herein, it should be understood that the invention is also applicable to other types of engines, such as in-line cylinder engines and rotary engines, and that the engine may contain fewer or more than eight cylinders or combustion chambers 16.

The HEUI fuel system 12 preferably includes one or more HEUI injectors 10, a source of hydraulic actuating fluid and damping fluid 18 which is connected to each HEUI injector 10, a source of fuel 20 which is connected to each HEUI injector 10, and a source for electronically controlling the HEUI fuel system 22 such as an electronic control module (ECM)24 which is connected to the HEUI injector 10. While HEUI injectors 10 are preferred in this embodiment, other applications might include non-unitized injectors.

The source of hydraulic actuating fluid and damping fluid 18 which is connected to each HEUI injector 10 includes a sump 26. A low pressure transfer pump 28 draws fluid from the sump 26. The fluid drawn from the sump 26 through the low pressure transfer pump 28 passes through a cooler 30, and a filter 32. The cooled and filtered fluid is passed through oil conduit 33 to a high pressure pump 34. The high pressure pump 34 provides fluid flow through an output port 36 and oil drain conduit 37. The amount of fluid flow in the output port 36 and oil drain conduit 37 is determined by an electrical signal S9 delivered by conductor 35 from the ECM 24 to the high pressure pump 34. The signal S9 from the ECM 24 is determined as a function of one or more input data signals S1 through S8 representative of predetermined system parameters. Hydraulic actuating fluid is passed from the output port 36 of the high pressure pump 34 pass the check valves 38 to the hydraulic actuating fluid manifolds 40 by a high pressure oil conduit 39. Excess fluid is routed back to the sump 26 by oil drain conduit 37. Hydraulic actuating fluid within the manifolds 40 is in fluid communication with the unit injectors 10. The relationship between the hydraulic actuating fluid within the manifolds 40 and the unit injectors 10 will be discussed later in detail.

The source of fuel which is connected to each HEUI injector 20 includes a fuel tank 42. A transfer pump 44 draws fuel from the fuel tank 42. The fuel drawn from the fuel tank 42 passes through the transfer pump 44, a fuel filter 46, and a fuel conduit 47 into fuel manifolds 48. The fuel manifolds 48 are in fluid communication with the unit injectors 10 by the fuel conduit 47. The fuel conduit consist of a drilled passage in the cylinder head 52. While drilled passages are preferred in this embodiment, other applications might include steel tubing, flexible house, and combinations of these devices. Fuel is supplied to the fuel manifolds 48 and fuel injectors 10 at a relatively low pressure for example, about 276 to 413 kPa or 40 to 60 psi). The relationship between the fuel manifolds 48 and the unit injectors 10 will be discussed later in detail.

The source for electronically controlling the HEUI fuel system 22 such as an ECM 24 which is connected to the HEUI injector receives input data signals from one or more signal indicating devices providing signals S1 through S8. Input data signals may, for example, include engine speed S1, engine crankshaft position S2, engine coolant temperature S3, engine exhaust back pressure S4, air intake manifold pressure S5, hydraulic actuating fluid manifold pressure S6, throttle position or a desired fuel setting S7, and transmission operating condition indicative signal S8, which for example, may indicate the gear setting of the transmission. The output control signal S9 is the actuating fluid manifold pressure command signal directed from the ECM 24 through the conductor 35 to the high pressure pump 34. The output control signal S9 controls the supply of hydraulic actuating fluid and damping fluid 18 to the unit injector 10. The HEUI fuel system 12 allows an injection start point, an injection stop point, and the injection pressure to all be regulated independent of engine speed and load. The quantity of fuel delivered can be varied independent of engine speed and load. In order to start injection independent of engine speed and load, a fuel delivery command signal S10 is emitted by the ECM 24 and delivered to the solenoid assembly 60. In order to end injection, or control the quantity of the fuel injected independent of engine speed and load, the ECM 24 discontinues its fuel delivery command signal S10 to the solenoid assembly 60. The relationship between the fuel delivery command signal S10 and the unit injectors 10 will be discussed later in detail.

Figure 2:
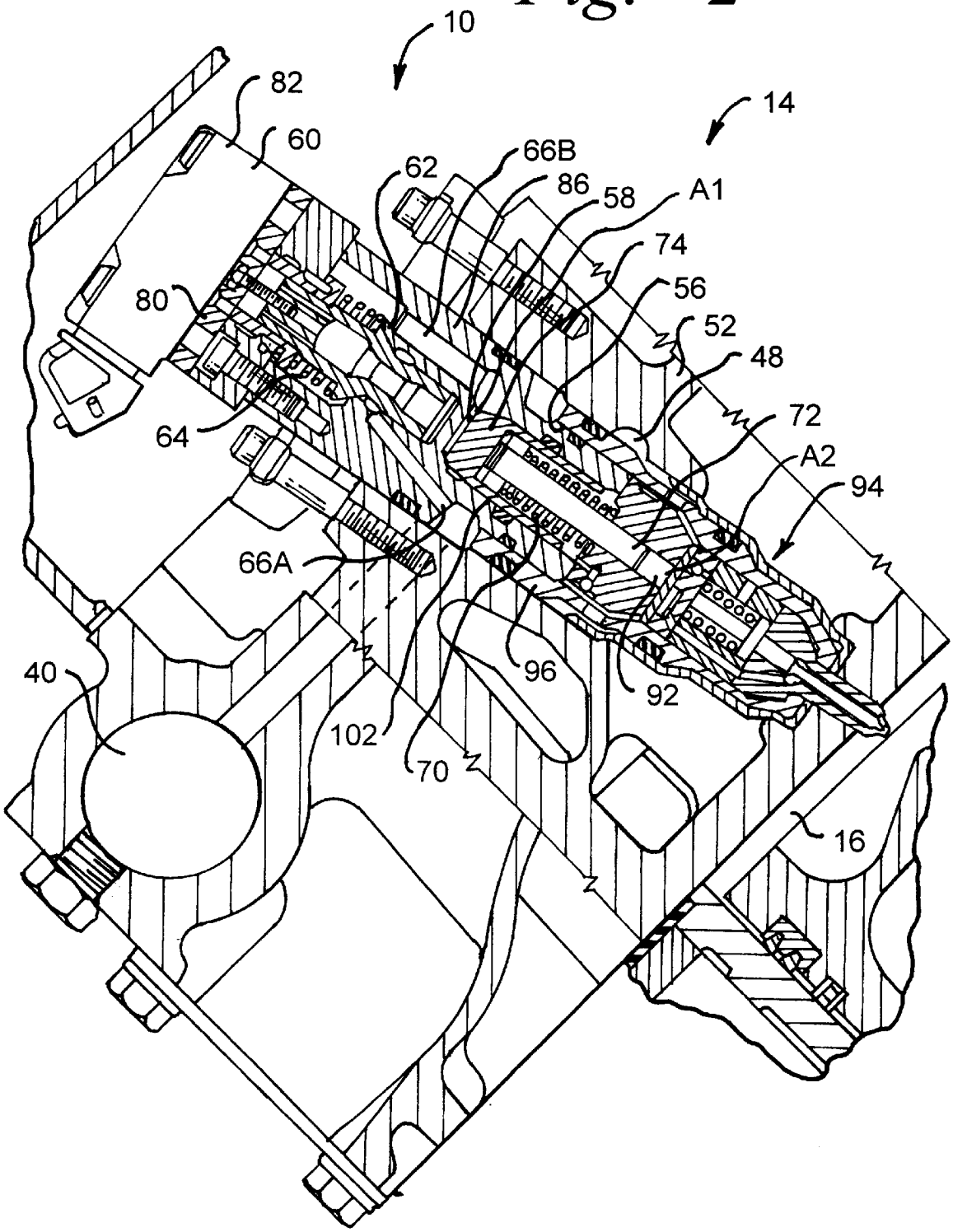
FIG. 2 is a diagrammatic partial cross-sectional view of one embodiment of a unit injector of FIG. 1 as installed in an exemplary internal combustion engine.

Referring to FIG. 2, a HEUI injector 10 which utilizes a stepped injection flow rate shape which is identified by its corresponding rate trace is shown relative to a portion of the cylinder head 52.

An actuator and valve assembly 84 of unit injector 10 is provided for selectively communicating either high pressure actuating fluid or low pressure damping fluid to the unit injector 10 in response to receiving an electronic fuel delivery command signal S10. The actuator and valve assembly 84 includes an actuator 60, preferably in the form of a solenoid assembly 60, and a valve 62, preferably in the form of a poppet valve 62. The solenoid assembly 60 includes a stator 82 fixed to the body 86 and a movable armature 80. The poppet valve 62 is slidably disposed in a poppet valve bore 64 and is fixed to the movable armature 80.

Figure 3:
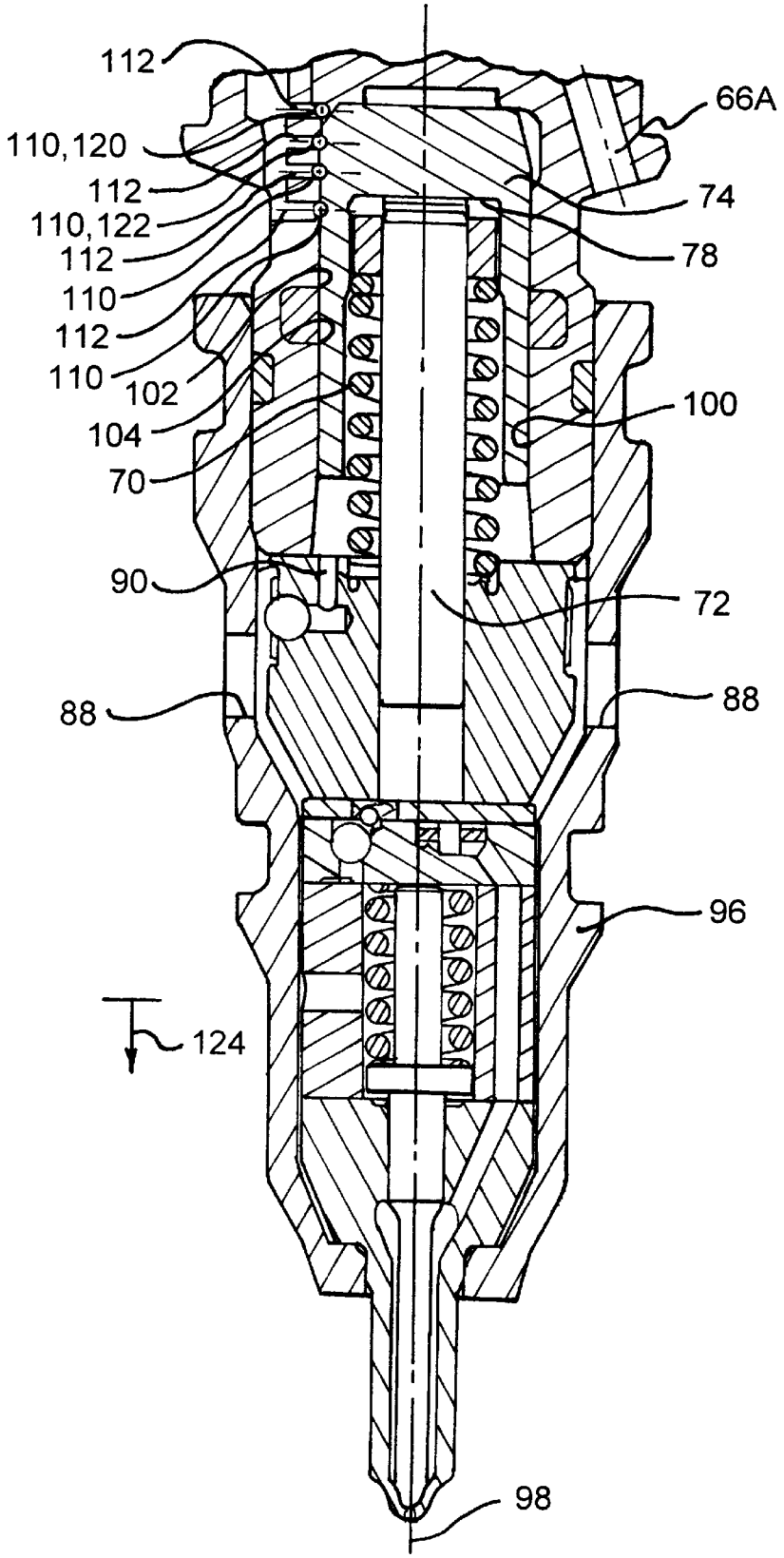
FIG. 3 is a diagrammatic enlarged detail of a portion of the fuel injector shown in FIG. 2.

Referring to FIG. 2 and 3, the HEUI injector 10 has a casing 96 having a central axis 98and a body receiving bore 100. The casing 96 is used for supporting and retaining sub-components of the HEUI injector 10.

Figure 4:
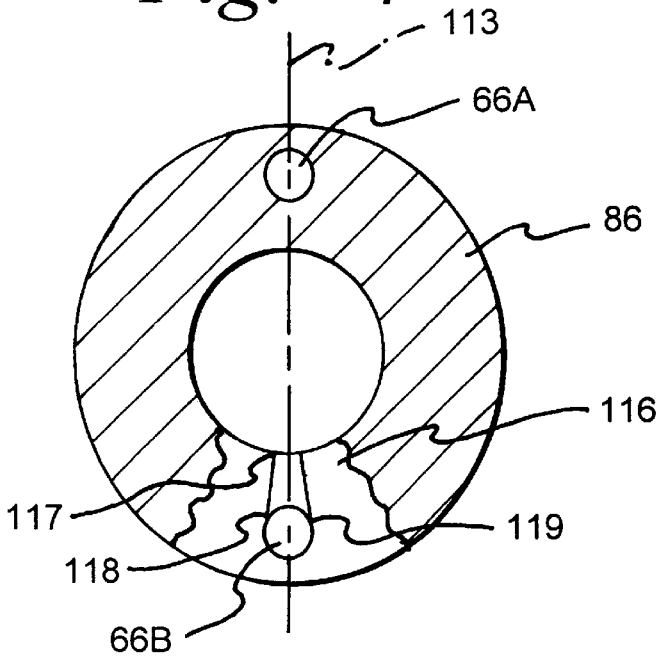
FIG. 4 is a diagrammatic cross-sectional view taken along line 4—4 of FIG. 3.

A body 86 of the unit injector 10 is disposed in the body receiving bore 100 and has a piston bore 102 which is defined by a cylindrical surface 104 and a longitudinal axis 106. The piston bore 104 has a closed end surface 108. The body 86 also defines pressurized fluid passages 66A and 66B which connect the hydraulic actuating fluid manifold 40 with a piston pressure chamber 58. The hydraulic actuating fluid and damping fluid is blocked from communicating with the piston pressure chamber 58 while the solenoid assembly 60 is in its de-energized state. The poppet valve 62 is biased to a first blocking position by a poppet spring 64, blocking fluid communication between the high pressure fluid passages 66A and 66B, thereby preventing high pressure actuating fluid from passing through the spaced apart fluid delivery apertures 110 into the piston pressure chamber 58. The spaced apart fluid delivery apertures 110 open into the piston bore 102. Each spaced apart fluid delivery aperture 110 has a centrally located axis 112 included in a plane 113 (FIG. 4). The piston bore's 102 longitudinal axis 106 and the centrally located axis 112 lye substantially in the plane 113 (FIG. 4). The spaced apart fluid delivery apertures 110 are spaced apart normally relative to the longitudinal axis 106 and the cylindrical surface 104 of the piston bore 102. The spaced apart fluid delivery apertures 110 have a first and a second end portion 116,118. The first end portion 116 opens into the pressurized fluid passage 66B and the second end portion 118 opens into the piston bore 102. The first end portion 116 has a first pre-selected diameter 117 and the second end portion 118 has a second pre-selected diameter 119. The first pre-selected diameter 117 is less than the second pre-selected diameter 119. It is to be noted that, the spaced apart fluid delivery apertures may have a cylindrical surface where the first pre-selected diameter 117 and the second pre-selected diameter 119 are substantially equal in magnitude. The piston pressure chamber 58 is defined by the first end surface 76 of the intensifier piston 74, the closed end surface 108 of the piston bore 102, and cylindrical surface 104 of the piston bore 102. The ECM 24 generates a pre-selected wave form which is conducted to the solenoid assembly 60 of a selected unit injector 10. Hydraulic actuating fluid is in communication with the piston pressure chamber 58 while the solenoid assembly 60 is in its energized state. The solenoid assembly 60 is electronically energized so that the armature 80 is magnetically drawn toward the stator 82. The poppet valve 62 is moved by the armature 80 to an inject position where the high pressure fluid passages 66A and 66B are fluidly connected, directing hydraulic actuating fluid at a relatively high pressure (for example, about 23 Mpa or 3335 psi) into the piston pressure chamber 58, thereby hydraulically exerting a driving force on the intensifier piston 74. The intensifier piston 74 has a first end surface 76 and a second surface 78. The second surface 78 is opposite from the first end surface 76. The Intensifier piston 74 is slidably axially movably disposed in the piston bore 102. The high pressure actuating fluid displaces the intensifier piston 74 and plunger 72 in opposition to the force generated by the compressed plunger spring 70 and the fuel pressure.

The low pressure fuel from the fuel manifold 48 flows through case fuel inlet holes 88 into the fuel inlet passage 90. The relatively low pressure fuel flows into the plunger pressure chamber 92 when the pressure in the plunger pressure chamber 92 is lower than the pressure in the piston pressure chamber 68. The supplied fuel in the plunger pressure chamber 92 is pressurized to a level which is a function of the pressure of the actuating fluid in the piston pressure chamber 68 and the effective area A1/A2 between the intensifier piston 74 and the plunger 72. This pressurized fuel flows from the plunger pressure chamber 92 and through the nozzle assembly 94 for the start of injection into the combustion chamber 16.

In order to start injection, the fuel delivery demand signal S10 is emitted by the ECM 24 and delivered to the solenoid assembly 60. The wave form generated by the ECM 24 energizes the solenoid assembly 60 of a selected unit injector 10 thereby allowing pressure to build in the plunger pressure chamber 92. The ECM 24 then discontinues its wave form, thereby electronically de-energizing the solenoid assembly 60 of the selected unit injector 10. The absence of the magnetic force allows the compressed poppet spring 64 to expand causing both the armature 80 and the poppet valve 62 to move back to their blocking positions. With negligible fluid pressure in the piston pressure chamber 68, the plunger spring 70 pushes upwardly against the plunger 72 and intensifier piston 74, seating the intensifier piston 74 against the closed end surface 108 of the piston bore 102.

Figure 5:
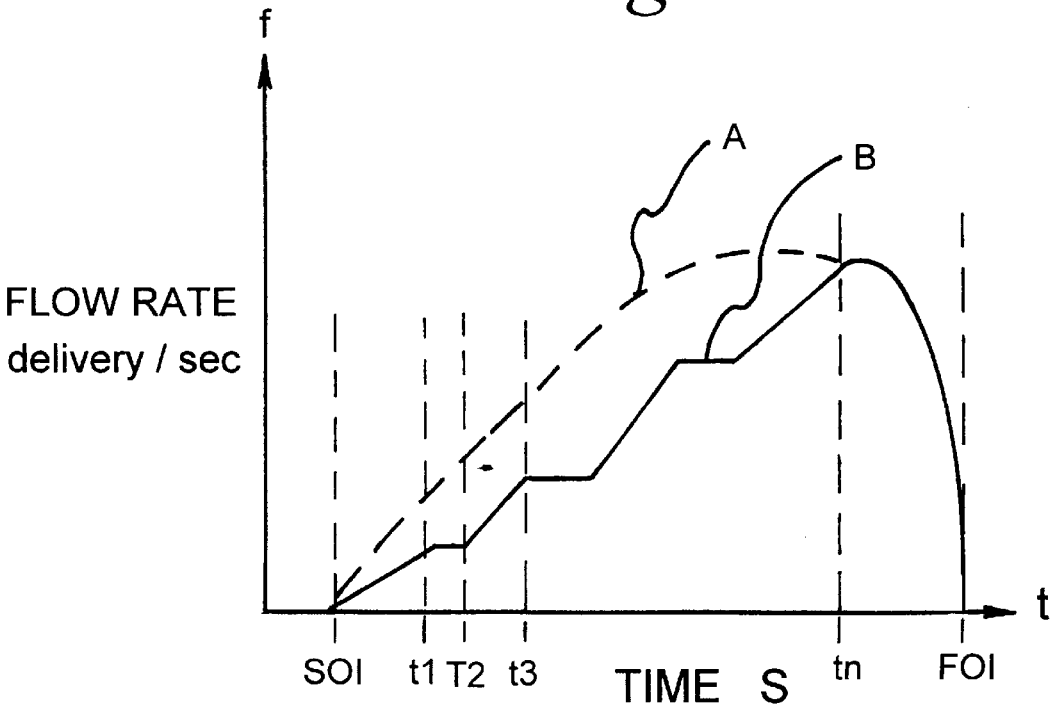
FIG. 5 is a graph showing a function of fuel injection as a function of time.

Referring to FIG. 5, the flow of the pressurized fuel through the spaced apart fluid delivery apertures 110 gives the present invention its rate shaping characteristic. The graph shows fuel discharge f into a combustion chamber 16 as a function of time t. The plots schematically illustrate fuel discharge both with and without the benefit of rate shaping according to the present invention. Line "A" of FIG. 5, shown as a dashed line shows the fuel injected without the benefit of the spaced apart fluid delivery apertures 110. Line "B", shown as a solid line, represents the fuel injected into the combustion chamber 16 with an injector 10 having the spaced apart fluid delivery apertures 110 of the present invention. It is readily evident that the fuel injection rate shaping decreases the amount of fuel injected into the combustion chamber 16 early in the injection cycle. SOI is the point in time where injection starts. Injection starts when the solenoid assembly 60 is energized to allow hydraulic actuating fluid to act on the intensifier piston which in turn pressurizes the fuel in the plunger pressure chamber 92. Time t1 is the point in time where hydraulic actuating fluid flow is through the first aperture 120 and fuel pressure is increasing. Time t2 is where the hydraulic actuating fluid flow is at the maximum rate for the first aperture 120 and the second aperture 122 is opening to hydraulic fluid flow. Time t3 is where the hydraulic actuating fluid flow is at the maximum rate for the first and second apertures 120,122. Time tn is where the flow is through all of the spaced apart fluid delivery apertures 110. EOI is the end of the injection cycle. The end of injection is when the fuel has been discharged through the nozzle assembly 94 into the combustion chamber 16. The degree or severity of rate shaping is determined by the first pre-selected diameter 117, second pre-selected diameter 119, distance between the spaced apart fluid delivery apertures 110, and the number of spaced apart fluid delivery apertures 110. The starting, ending, duration, and degree of rate shaping can be controlled by varying the appropriate above parameters to achieve a desired rate shaping for particular applications.

Industrial Applicability

With reference to the drawings and in operation, with the solenoid assembly 60 de-energized pressurized fluid is prevented from reaching the piston pressure chamber 58 by the poppet valve 62. The first aperture 120 is always opened to the piston pressure chamber 58. The ECM 24 sends a signal through conductor 41 to energize the solenoid assembly 60 allowing hydraulic actuating fluid to reach the piston pressure chamber 58 by connecting high pressure fuel passages 66A, 66B and to start injection. This is represented as SOI in FIG. 5. The hydraulic actuating fluid acts on the intensifier piston 74 to axially move the intensifier piston 74 in a first direction 124 in response to the hydraulic actuating fluid being passed through the first aperture 120 into the piston pressure chamber 58. This is represented as T1 in FIG. 5. The second aperture 122 is opened to pressurized fluid flow into the piston pressure chamber 58 in response to further movement of the intensifier piston 74 in the first direction 124. This is represented as T2 in FIG. 5. The intensifier piston 74 is moving at a first rate of speed where the pressurized fluid is passing through the first aperture 120 and a second rate of speed where the pressurized fluid is passing through the second aperture 122. This is represented as T3 in FIG. 5. The second rate of speed is greater than the first rate of speed. The spaced apart fluid delivery apertures 110 are sequentially opened into the piston pressure chamber 58 in response to subsequent movement of the intensifier piston 74 in the first direction 124. This is represented as Tn in FIG. 5. The ECM 24 stops sending a signal S10 to the solenoid assembly 60. The solenoid assembly 60 is de-energized blocking fluid communication between high pressure fuel passages 66A, 66B. This is represented as EOI in FIG. 5.

Other aspects, objects and advantages of this invention can be obtained from a study of the drawings, the disclosure and the appended claims.

I claim:

1. A stepped rate shaping fuel injector comprising:

a casing having a body receiving bore;

a body having a piston bore defined by a cylindrical surface, and a longitudinal axis, said piston bore having a closed end surface, said body being disposed in the body receiving bore;

an intensifier piston having a first end surface and being slidably axially movably disposed in said piston bore;

a piston pressure chamber defined by the first end surface of said intensifier piston, the closed end surface of said piston bore and said cylindrical surface; and a plurality of spaced apart fluid delivery apertures disposed in said body and opening into said piston bore, said intensifier piston being axially movable in a first direction in response to a pressurized fluid being passed through a first of said apertures into said piston pressure chamber, and a second of said apertures being open to pressurized fluid flow into said piston pressure chamber in response to further second aperture increasing movement of said intensifier piston in said first direction, said intensifier piston moving at a first rate of speed during the passing of pressurized fluid through said first aperture, and at a second rate of speed during the passing of pressurized fluid passing through the second of said apertures, said second rate of speed being greater than said first rate of speed.

2. The stepped rate shaping fuel injector, as set forth in claim 1, including said apertures each having a centrally located axis and including a plane, said longitudinal axis and said centrally located axis lying substantially in said plane.

3. The stepped rate shaping fuel injector 10, as set forth in claim 2, including said apertures being normal relative to said longitudinal axis and said cylindrical surface.

4. The stepped rate shaping fuel injector, as set forth in claim 1, including said piston being movable in said first direction from a first position at which said first of said apertures is open to said piston pressure chamber and said second of said apertures is blocked and a second position at which the first and second apertures are open to said piston pressure chamber.

5. The stepped rate shaping fuel injector, as set forth in claim 4, including said first end surface of said piston being engaged with said closed end surface of the piston bore at said first position, and said plurality of apertures being open to said piston pressure chamber at said second position.

6. The stepped rate shaping fuel injector, as set forth in claim 4, including said plurality of apertures being sequentially open to said chamber in response to further movement of said piston in the first direction.

7. The stepped rate shaping fuel injector, as set forth in claim 6, including a third of said apertures being open to the piston pressure chamber and said apertures passing pressurized fluid into said piston pressure chamber in response to further third aperture increasing movement of said piston in said first direction.

8. The stepped rate shaping fuel injector, as set forth in claim 1, including a pressurized fluid passage disposed in said body and said plurality of apertures each have a first end portion and a second end portion, said first end portion opening into said pressurized passage and said second end portion opening into said piston bore.

9. The stepped rate shaping fuel injector, as set forth in claim 8, including said first end portion having a first pre-selected diameter and said second end portion having a second pre-selected diameter, said first pre-selected diameter being less than said second pre-selected surface.

10. The stepped rate shaping fuel injector, as set forth in claim 8, including said plurality of apertures having a cylindrical surface.

11. A stepped rate shaping fuel injector comprising:

a casing having a body receiving bore;

a body having a piston bore defined by a cylindrical surface, and a longitudinal axis, said piston bore having a closed end surface, said body being disposed in the body receiving bore;

a piston having a first end surface and a second surface, said first end surface being slidably axially movably disposed in said piston bore, and said second surface being opposite from said first end surface;

a piston pressure chamber defined by the first end surface of said piston, the closed end surface of said piston bore and said cylindrical surface;

a barrel having a plunger receiving bore, said plunger receiving bore defined by a cylindrical surface, and said barrel being disposed in the body receiving bore;

a plunger having first and second spaced apart ends, said first end being engaged with the second surface of said piston, said second end being disposed in said barrel, and said plunger being slidably axially movably disposed in said plunger receiving bore;

a nozzle assembly having an end surface and being engaged with said barrel, said nozzle assembly being disposed in said body receiving bore;

a plunger pressure chamber defined by the second end surface of said plunger, the end surface of said nozzle assembly and said cylindrical surface of said barrel; and a plurality of spaced apart fluid delivery apertures disposed in said body and opening into said piston bore, said piston being axially movable in a first direction in response to a pressurized fluid being passed through a first of said apertures into said piston pressure chamber, and a second of said apertures being open to pressurized fluid flow into said chamber in response to further movement of said piston in said first direction, said plunger moving at a first rate of speed during the passage of pressurized fluid through said first of said apertures, and a second rate of speed during the passing of pressurized fluid through said second of said apertures, said second rate of speed being greater than said first rate of speed.

* * * * *